United States Patent [19]

Derry

[11] Patent Number: 4,991,844

[45] Date of Patent: Feb. 12, 1991

[54] APPARATUS FOR PLAYING A BALL GAME

[76] Inventor: David G. Derry, Muddlewood, Gonvena, Wadebridge, Cornwall, England

[21] Appl. No.: 349,257

[22] Filed: May 9, 1989

[30] Foreign Application Priority Data

May 12, 1988 [GB] United Kingdom ..... 8811246.1

[51] Int. Cl.[5] ..... A63D 3/02; A63B 71/00

[52] U.S. Cl. ..... 273/120 R; 273/118 R; 273/128 A; 273/129 Q

[58] Field of Search ..... 273/118 R, 120 R, 128 A, 273/129 Q

[56] References Cited

U.S. PATENT DOCUMENTS

| | | | |
|---|---|---|---|
| 1,048,047 | 12/1912 | Curtis | 273/128 A |
| 1,674,715 | 6/1928 | Caulkins | 273/128 A |
| 2,079,029 | 10/1937 | Hope | 273/120 R |
| 2,277,057 | 3/1942 | Bach | 273/128 A |
| 2,473,087 | 6/1949 | Almasi | 273/129 Q |
| 2,503,393 | 4/1950 | Lamprecht | 273/129 Q |
| 2,524,546 | 10/1950 | Sinclaire | 273/128 A |
| 2,905,472 | 9/1959 | Kinney, Jr. | 273/120 R |
| 3,195,267 | 7/1965 | Gehlen | 273/129 Q |
| 3,647,213 | 3/1972 | Baker | 273/129 Q |
| 3,843,129 | 10/1974 | Dietrich | 273/129 Q |

*Primary Examiner*—Randall L. Green
*Assistant Examiner*—Gary Jackson
*Attorney, Agent, or Firm*—Needle & Rosenberg

[57] ABSTRACT

Apparatus for playing a ball game, comprising a playing surface, a plurality of balls having an eccentric distribution of mass, and means for initiating rolling movement of the balls in a way which preserves the orientation of the eccentricity of mass distribution of the ball with respect to a rolling axis thereof.

9 Claims, 2 Drawing Sheets

APPARATUS FOR PLAYING A BALL GAME

BACKGROUND OF THE INVENTION

One of the appealing features of the outdoor game of bowls results from the practice of using asymmetrically weighted bowls which are shaped as an oblate spheroid, namely one having a somewhat flattened aspect at opposite ends of an axis through the spheroid. Asymmetric weighting along this axis results in the bowls following a curved path which can be more or less pronounced in dependence on the speed of the bowl.

OBJECTS OF THE INVENTION

It is an object of the invention to provide a game, in miniature form, as a board game, which corresponds to a full size game and which can be played, for example, in substitution for the real thing during inclement weather. It is a further object of the present invention to provide a board game offering all the available play options which can be gained from the full scale game of bowls.

SUMMARY OF THE INVENTION

According to the present invention, therefore, apparatus for playing a ball game comprises a playing surface, a plurality of balls having an eccentric distribution of mass, and means for initiating rolling movement of the balls in a way which preserves the orientation of the eccentricity of mass distribution of the balls with respect to the rolling axis thereof.

In the full scale game of bowls the axis of eccentricity, namely the axis joining the barycenter of the mass with the geometrical center of the bowl can easily be determined by reference to the oblate spherical shape. It is not a practical proposition to produce small scale spheroids of this form and alternative means have been devised, in accordance with the principles of the present invention, in order to make it possible to provide an eccentric mass distribution within a spherical outer surface.

The playing surface itself preferably comprises a generally rectangular board having surrounding upstanding walls, these latter being required in order to limit the movement of balls projected inadvertently or without sufficient skill to come to rest within the area of the playing surface.

As is known, the game of bowls is played on a rectangular strip of grass or other suitable surface. The rules provide that a small target ball or "jack" be rolled from a playing area defined by a mat on which the players stand to roll their bowls. Successive players then attempt to position their bowls as close to the jack as possible by rolling them in a curved path from the mat towards the jack. The board game of the present invention simulates this by initiating rolling movement of a spherical ball along the playing area towards a target which, as in the full scale game, may be represented by a smaller spherical ball or jack. The balls representing the bowls, which have an eccentric mass distribution, preferably have a spherical outer surface and the eccentric mass distribution is preferably produced by forming a generally radially extending cavity therein such that the barycenter of the ball is spaced from the center of the spherical outer surface thereof to define a first axis joining the barycenter and the geometric center of the sphere. If the cavity is left open then the point where it intersects the spherical surface can be used to identify the said axis for positioning the ball before initiating rolling movement. It is important that the notional center of gravity or barycenter of the ball be positioned on the rolling axis since, otherwise, the eccentricity of the mass would lead to irregularity in rolling rather than the desired curved rolling path.

If it is undesirable that the cavity be left open this may be covered or filled with a material of lower density than that of the ball itself so that the eccentricity, whilst being perhaps marginally reduced, nevertheless remains sufficiently pronounced for the purposes of the game. If the cavity is filled it is preferred that the position of the said axis joining the barycenter and the geometric axis of the spherical outer surface be marked with some indication of its location, preferably using an index which is distinguishable in a visual or tactile manner. In other words the end of the axis which should preferably be used as the rolling axis may be marked with a coloured spot or a detent or indentation in the surface.

Preferably the playing surface comprises a generally rectangular board having surrounding upstanding walls and in a preferred embodiment of the invention the playing surface is formed as an elongate rectangle with a transversely extending groove or recess extending across its width at or adjacent one or both ends thereof. This groove simulates the ditch at each end of the playing area for receiving and retaining any balls played too long and thereby conveniently limiting the playing surface.

With the playing surface being formed as an elongate rectangle it may further be provided with raised, transversely extending wall portions passing laterally across its width in correspondence with the said groove. This constitutes a representation of the bank additionally provided adjacent the ditch at the ends of the playing area to serve as an abutment and to ensure that no balls bounce out of the playing area even if projected more violently than usual.

Because it is formed as a board game the apparatus of the present invention is equipped with means for initiating rolling motion of the balls different from that employed in the full scale game of bowls. In the latter the bowls are rolled by hand from a slightly crouching position with the player's arm extending fully to gain maximum control. In the apparatus of the present invention the means for initiating rolling motion of the balls preferably comprises an inclined ramp the inclination and orientation of which is adjustable by the player. Such an inclined ramp preferably has upstanding sides for guiding the rolling motion of the balls upon initiation thereof although a number of different configurations may be employed. For example, in the preferred embodiment of the invention to be described hereinbelow the inclined ramp is formed as a chute with a generally V-shape cross-section. Alternatively, however, the ramp may be formed as two parallel guide surfaces which may be the upper edges of two parallel vertical walls or may be two parallel guide rods the separation of which is less than the diameter of a ball to be guided thereby. Such structures preserve the orientation of a ball about its rolling axis so that it can be positioned in the selected orientation with the center of gravity on the rolling axis and it will retain this orientation during initiation of movement. Once rolling, of course, the ball will not be subject to influences likely to deflect it from this rolling orientation unless the ball should strike a side wall or an end wall.

Other features and advantages of the present invention will become apparent from a study of the following detailed description in which reference will be made to the accompanying drawings, provided purely by way of non-limitative example only.

DESCRIPTION OF THE PREFERRED EMBODIMENT

Figure 1:
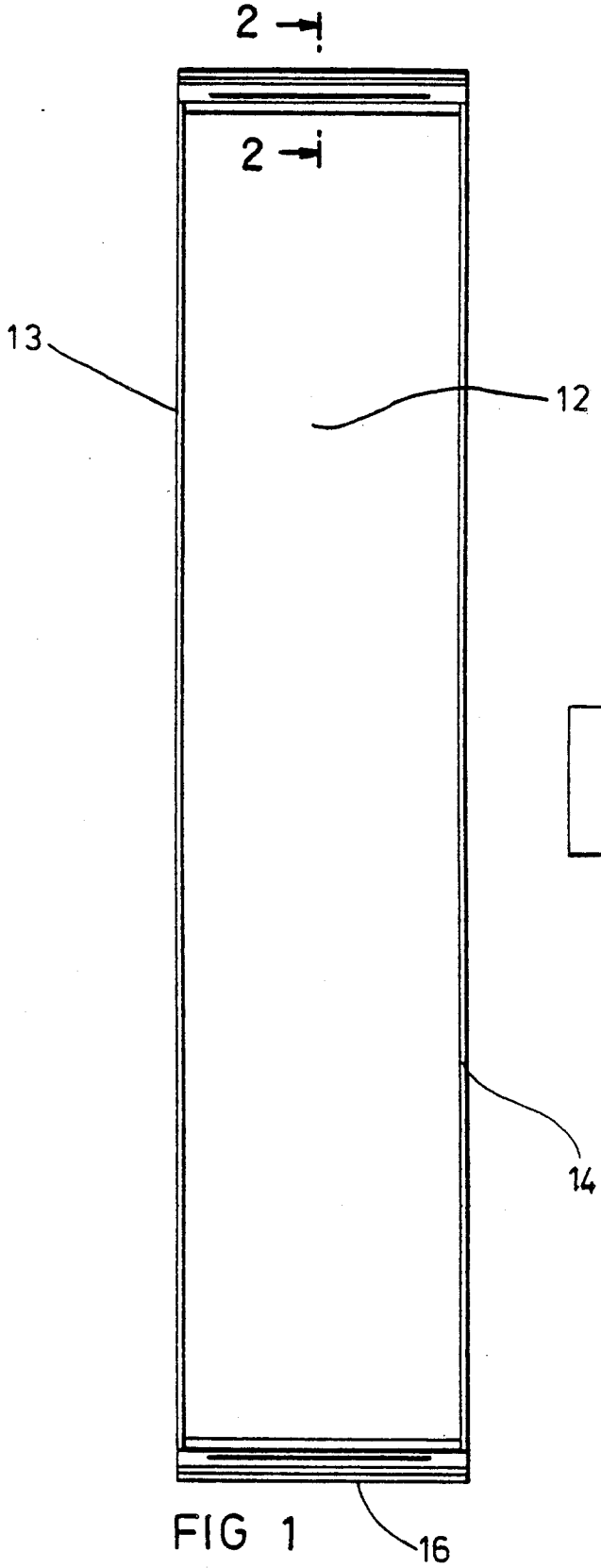
FIG. 1 is a plan view of a board formed as a playing surface of an embodiment of the present invention.
Figure 2:
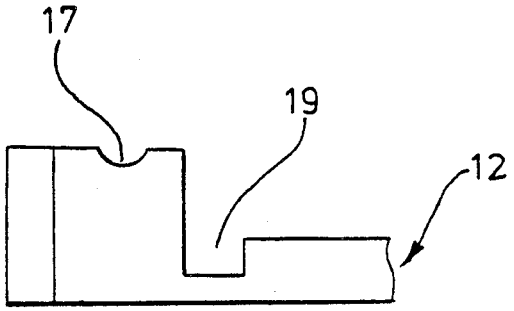
FIG. 2 is a schematic sectional view taken on the line II—II of FIG. 1.

Referring now to the drawings, the apparatus shown comprises a board generally indicated 11 providing a playing surface 12 of elongate rectangular form having two upstanding shallow side walls 13, 14 spanned at each end by two rather taller upstanding end walls 15, 16. The end walls 15, 16 have transverse grooves 17, 18 in their upper surfaces and are separated from the playing surface 12 itself by respective transverse grooves 19, 20 each of which forms a channel or ditch between one end of the playing surface 12 and the associated end wall 15, 16. In a practical configuration the board 11 may be made from wood based materials such as hard wood or plywood and appropriately fabricated to produce the integers described hereinabove. Alternatively, however, the board may be integrally moulded or vacuum formed as a one-piece element incorporating the walls and channels as described.

Figures 3, 4:
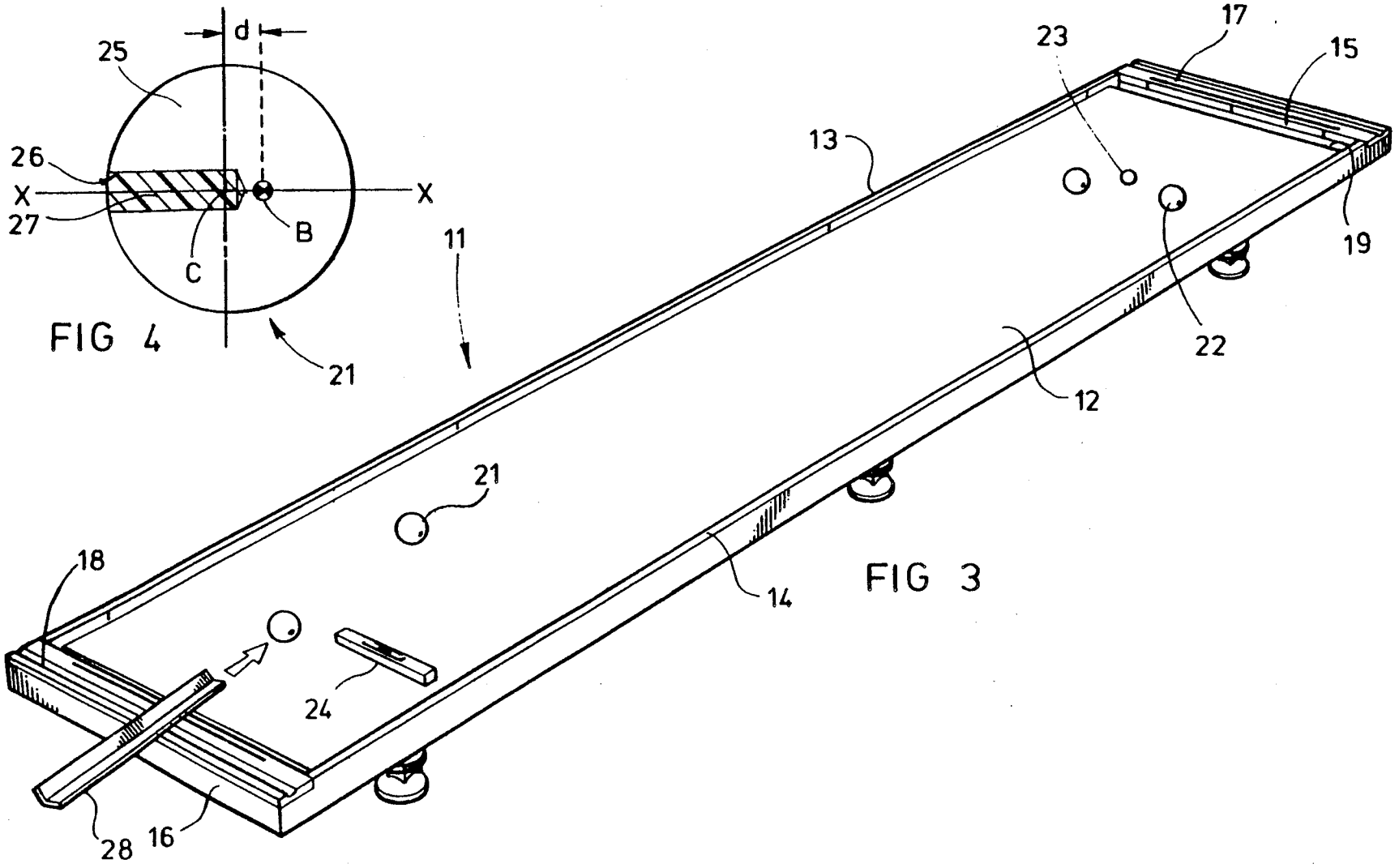
FIG. 3 is a schematic perspective view of the apparatus of the present invention in a typical configuration of use.
FIG. 4 is a cross-sectional view through a ball of the apparatus of the invention.

The apparatus of the invention further comprises a plurality of asymmetric bowling balls 21, 22 which are formed from unhardened steel balls (suitably the balls produced for rolling element bearings prior to hardening) which have been rendered asymmetric by drilling a large diameter radial hole or cavity into it. The interior of the cavity may be painted to produce a characteristic identifying mark so that, for example, bowls 21 belonging to one set can be distinguished from bowls 22 belonging to another by the colour of the cavity. Alternatively, as envisaged above, the cavities may be filled with a lightweight material which itself may be coloured to produce a characteristic spot on the "light" side of the ball and which may thus also identify the rolling axis of the ball. A typical such ball is shown in cross-section in FIG. 4. The ball shown in FIG. 4 is represented as the bowling ball 21 having a solid body 25 in which is drilled a radial hole 26 passing through the geometric center C of the spherical body. The bore 26 is filled with a lightweight plastics material 27 of characteristic colour as referred to above. The barycenter B of the composite body comprising the ball 25 and filling 27 in the bore 26 is offset by the distance d from the geometric center C such that the ball has an eccentricity which can influence its path when rolled along an axis defined by a projection of the line joining the barycenter B and the geometric center C identified in FIG. 4 with the letters X—X.

A smaller steel ball 23 serves as the jack or target.

In order to launch the balls to play the game there is provided a launching ramp 28 which, in this embodiment, is formed as a V-section chute which can be rested on the top surface of one or other of the end walls 15, 16 and inclined more or less steeply according as the player wishes to project a ball a greater or shorter distance along the playing surface 12. By carefully positioning the ball on the chute with the spot representing the end of the cavity in alignment with the rolling axis of the ball it can be ensured that the ball is entirely symmetrical about this rolling axis so that it rolls smoothly upon launch and follows a curving path 2 come to rest as illustrated by the ball 22 in the vicinity of the jack 23.

Since the apparatus of the present invention is intended to be placed on a surface for use, and such surface may not be entirely horizontal, the playing surface 12 may be supported on a number of legs (not shown) via an intermediate underlying reinforcement frame, each leg being adjustable in length in order to compensate for any inclination of the support surfaces on which the apparatus is placed. A spirit level 24 is included as part of the apparatus for testing that the playing surface 12 is entirely level before play commences.

I claim:

1. Apparatus for playing a ball, game, comprising:

a playing surface, a plurality of balls having an eccentric distribution of mass, and means for initiating rolling movement of a selected one of said balls in a way which preserves the orientation of the eccentricity of mass distribution of said ball with respect to the rolling axis thereof, wherein said balls have a spherical outer surface and said eccentric mass distribution of said balls is produced by forming a generally radially extending cavity therein such that spherical outer surface of said ball to define a first axis joining the barycenter and the geometric center of said spherical outer surface, and further wherein one end of said axis defined by the straight line joining said geometric center of the spherical surface of a ball and said barycenter of the mass thereof is marked with an index detectable in one of a visual and tactile manner.

2. The apparatus of claim 1, wherein said playing surface comprises a generally rectangular board having surrounding upstanding walls.

3. The apparatus of claim 1, wherein said playing surface is an elongate rectangle and has a transversely extending groove or recess extending across its width at or adjacent one or both ends thereof.

4. The apparatus of claim 3, wherein said playing surface is an elongate rectangle and is provided with raised transversely extending wall portions extending across its width in correspondence with the said groove.

5. The apparatus of claim 1, wherein said means for initiating rolling motion of said selected one of said balls comprises an inclined ramp the inclination and orientation of which is adjustable by the player.

6. The apparatus of claim 5, wherein said inclined ramp has upstanding sides for guiding the rolling motion of said balls upon initiation thereof.

7. The apparatus of claim 6, wherein said inclined ramp is formed as a chute with a generally V-shape cross-section.

8. The apparatus of claim 1, wherein said generally radially extending cavity is filled with a material less dense than that of the ball itself.

9. The apparatus of claim 1, wherein said opening to said cavity is covered.

* * * * *